US005289157A

United States Patent [19]

Rudick et al.

[11] Patent Number: 5,289,157

[45] Date of Patent: Feb. 22, 1994

[54] MEDICINE REMINDER AND STORAGE DEVICE

[75] Inventors: Arthur G. Rudick, Marietta, Ga.; Michael Mahle, Rochester, N.Y.

[73] Assignee: Vitafit International, Inc., Chicago, Ill.

[21] Appl. No.: 812,770

[22] Filed: Dec. 23, 1991

[51] Int. Cl.[5] ..... G08B 1/00; G04B 47/00

[52] U.S. Cl. ..... 340/309.15; 340/573; 368/10; 368/109

[58] Field of Search ..... 340/309.15, 573; 368/10, 109

[56] References Cited

U.S. PATENT DOCUMENTS 3,762,601 10/1973 McLaughlin .
3,903,515 9/1975 Haydon et al. .
3,999,050 12/1976 Pitroda .
4,258,354 3/1981 Carmon .
4,275,384 6/1981 Hicks et al. .
4,360,125 11/1982 Martindale et al. .
4,382,688 5/1983 Machamer .
4,473,884 9/1984 Behl .
4,504,153 3/1985 Schollmeyer et al. .
4,526,474 7/1985 Simon .
4,626,105 12/1986 Miller .
4,682,299 7/1987 McIntosh et al. .
4,731,765 3/1988 Cole et al. .
4,768,176 8/1988 Kehr et al. .
4,768,177 8/1988 Kehr et al. .
4,831,562 5/1989 McIntosh et al. .
4,837,719 6/1989 McIntosh et al. .
4,839,806 6/1989 Goldfischer et al. .
4,899,839 2/1989 Dessertine et al. .
4,942,544 7/1990 McIntosh et al. ..... 340/309.15
4,962,491 10/1990 Schaeffer .
5,014,875 5/1991 McLaughlin et al. .
5,020,037 5/1991 Raven .
5,088,056 2/1992 McIntosh et al. ..... 340/309.15

*Primary Examiner*—Donnie L. Crosland
*Attorney, Agent, or Firm*—Dickstein, Shapiro & Morin

[57] ABSTRACT

A portable electronic alarm device containing a plurality of compartments for storing a limited supply of medications and indicating when a medicine should be taken according to a predetermined schedule. The device also records the times that alarms sound and the times that they were acknowledged. The user can review the recorded times to determine compliance with the schedule. Additionally, a base station is provided to support the device, store larger supplies of medicine, and provide amplified alarms.

11 Claims, 7 Drawing Sheets

MEDICINE REMINDER AND STORAGE DEVICE

FIELD OF THE INVENTION

The present invention relates to an electronic alarm device which indicates when medication should be taken. In addition, the present invention relates to such devices which also include medication storage compartments and memory for recording and reviewing compliance with medication schedule.

BACKGROUND OF THE INVENTION

Medications are most effective when taken according to the prescribed schedule. However, people often fail to comply with a medication schedule due to forgetting how often medication should be taken or when they last took the medication. Such problems are especially prevalent with those who take several medications on different schedules. The elderly are especially prone to problems since they often take several medications and often have failing memories.

Various electronic devices exist for assisting the user in following a medication schedule. Generally these devices consist of a timer which activates an alarm when medication is to be taken. Exemplary devices are described in U.S. Pat Nos. 4,258,354, 4,768,176, 4,837,719 and 5,020,037.

U.S. Pat. No. 4,258,354 discloses a portable alarm device which stores medications within a plurality of compartments and sounds an alarm indicating when a medication in one of the compartments is to be taken. The times for taking medication are programmed at hourly intervals by inserting a strip which contains perforations indicating the schedule.

U.S. Pat. No. 4,768,176 discloses an apparatus for alerting a patient to take medication which contains compartments for each medication and an alarm indicating when, and which medication, should be taken. The alarm is deactivated when the appropriate compartment is accessed. A "night" switch operates to deactivate all future alarms until a specified time in the morning.

U.S. Pat. No. 4,837,719 discloses a medication clock for signaling the times that dosages of a medication should be taken. The device also provides a record of when each medicine was taken for comparison with the medication schedule. In addition, the device can monitor and record temperature, blood pressure and pulse rate of the user.

U.S. Pat. No. 5,020,037 discloses an alarm pill box which cancels the alarm when a compartment lid is opened. A visual display is used to indicate the number of times that the lid has been opened within one day.

In summary, these patents disclose a device which provides various procedures for alerting a user when medication should be taken and, in some instances, recording when medications were taken. However, these devices do not provide a simple portable unit which stores medications and indicates when the medication is to be taken. Additionally, the devices do not provide the user with the ability to review the schedule to insure that medication is taken at proper times and to determine when medications are to be taken in the future. The devices also fail to allow for irregular schedules for medications taken at different times on subsequent days.

SUMMARY OF THE INVENTION

In view of the foregoing, it should be apparent that there still exists a need for a device which provides a simple, "user friendly" procedure for entering alarm times, responding to alarms, and reviewing the alarm schedule. Therefore, it is a primary object of this invention to provide a simple, portable electronic device for signaling when medication should be taken according to a program schedule for a number of medications taken at various times.

It is another object of the invention to allow the program schedule to include regular or irregular time intervals, including time intervals greater than 24 hours for any of the medications.

It is another object of this invention to record when medication was taken in response to a signal and when medication has not been taken within a designated time of the signal.

It is another object of this invention to allow the user to review the medication schedule for any medication including when alarms have sounded, if and when they were responded to, and which alarms have yet to sound.

It is another object of this invention to allow the user to review the medication schedule for all medications to determine when the last alarm sounded and when the next alarms will occur.

These and other objects of the invention are accomplished by a portable electronic device which includes drawer-type compartments for containing a small supply of medication. The medication schedule is programmed in the device by entering a time of day for each alarm corresponding to each medication. The device also allows for programming alarm times which vary on subsequent days or which spread over a number of days. The device also allows the user to review a record in memory of when alarms sounded and when they were responded to in order to monitor the taking of medication.

With these and other objects, advantages and features of the invention which may become apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
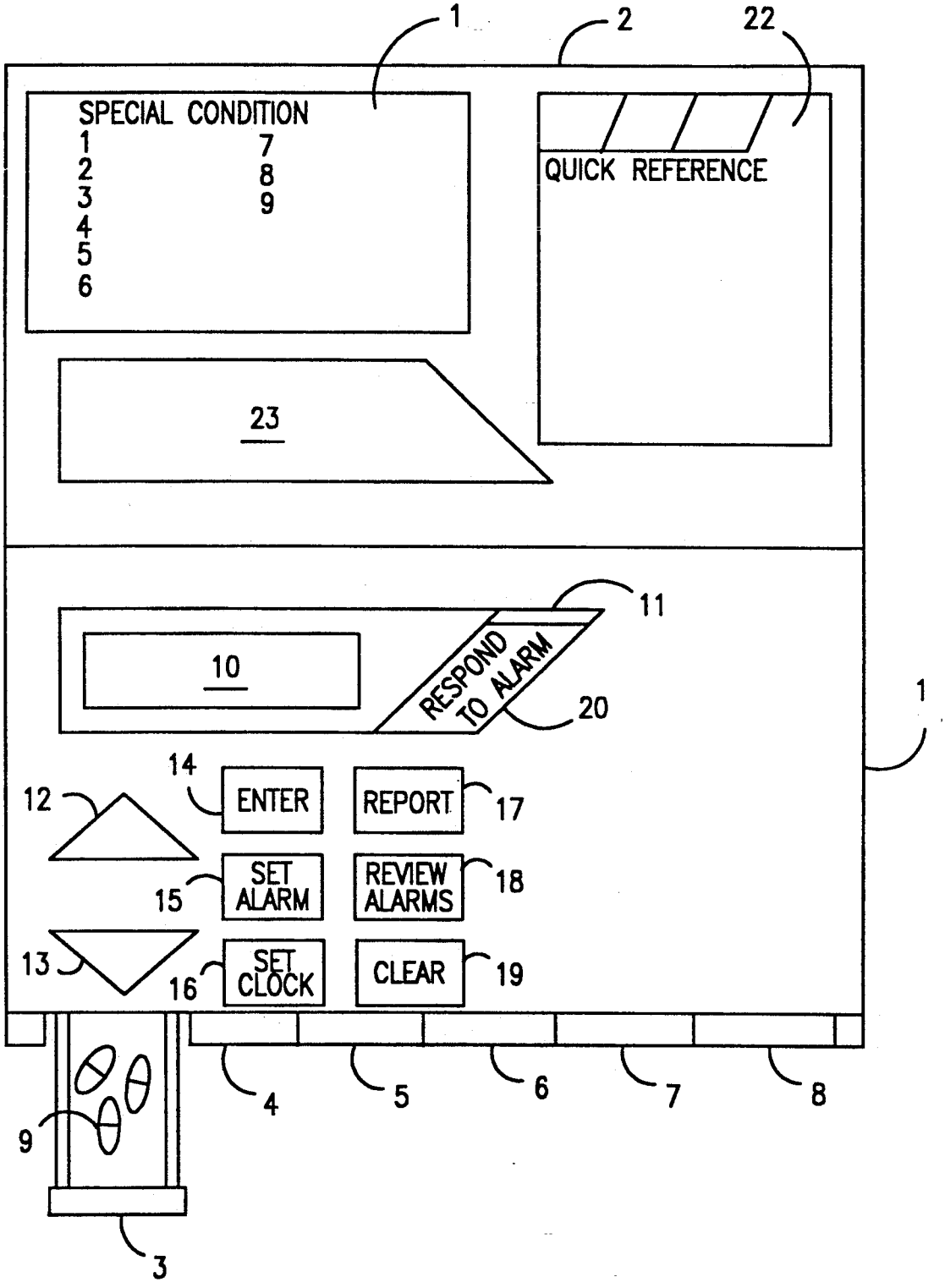
FIG. 1 is a top view of a device according to the preferred embodiment of the present invention.
Figure 2:
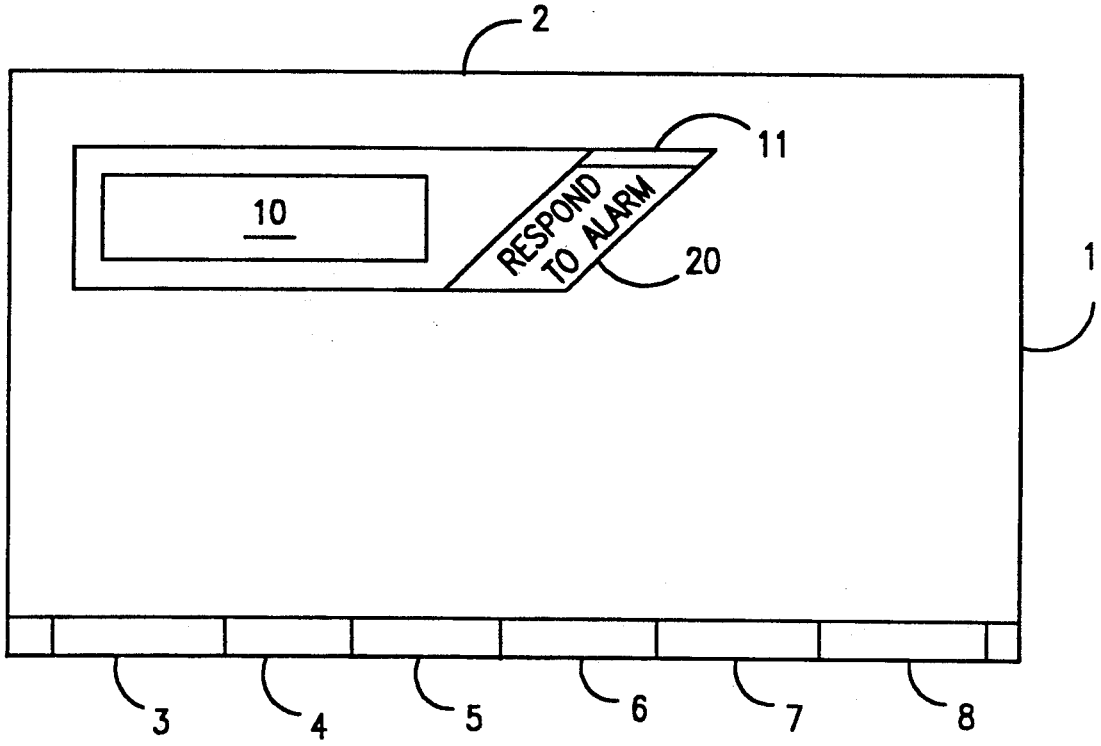
FIG. 2 is a top view of an apparatus according to the present invention with an attached cover closed.
Figure 3:
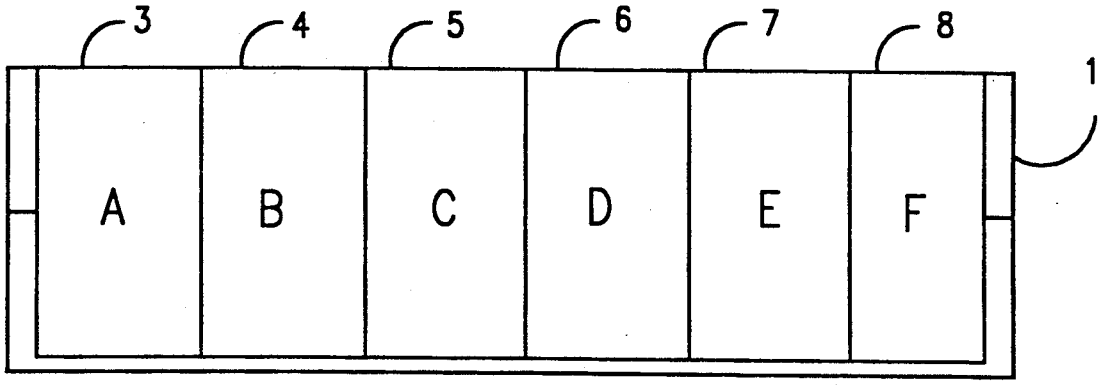
FIG. 3 is a front view of the apparatus shown in FIG. 1.

Referring now in detail to the drawings wherein like parts are designated by like reference numerals throughout, there is illustrated in FIG. 1 a top view of a portable medication reminding device according to a preferred embodiment of the present invention. The device is sized to fit easily into a purse or into a vest pocket. The device 1 includes a cover section 2 which prevents accidental operation of the keys when closed. The device 1 includes six drawer-like compartments 3–8 into which a limited supply of medication 9 are placed. The fronts of the compartments 3–8 are labeled with a letter, as shown in FIG. 3, and are color-coded. Color and letter-coded labels (not shown) can be placed on the medicine bottles corresponding to each compartment to prevent confusion when refilling the compartment. The device 1 includes a display 10, which can be a super twist liquid crystal (LCD) dot matrix display. In the preferred embodiment, the display is one line by 20 characters. The device 1 is operated by a number of keys 12–20, in response to information displayed on the display. The use of the keys is explained more fully below in discussing the operation of the system. The device 1 includes a visual indicator 11, such as a light emitting diode, and an audio alarm (not shown) for indicating when a medication should be taken. The cover of the device 2 includes a numbered listing of special conditions 21 common with taking medications, such as "take with water", "take with a meal," "take on an empty stomach," etc. The condition numbers are entered with the medication schedule as more fully described with respect to FIG. 5. The cover section 2 also includes a set of cards 22 containing a simple, concise set of operating instructions. The cover section 2 has a cutout portion 23 which allows access to the display 10, the visual indicator 11, and the Respond to Alarm key 20 when the cover is closed.

The operation of the reminder device is controlled by a microprocessor (not shown) connected to the display 10, the visual indicator 11, and the keys 12–20. The microprocessor is suitably programmed, and contains sufficient memory to operate according to the procedures more fully disclosed and described with respect to FIGS. 4–9.

Figure 4:
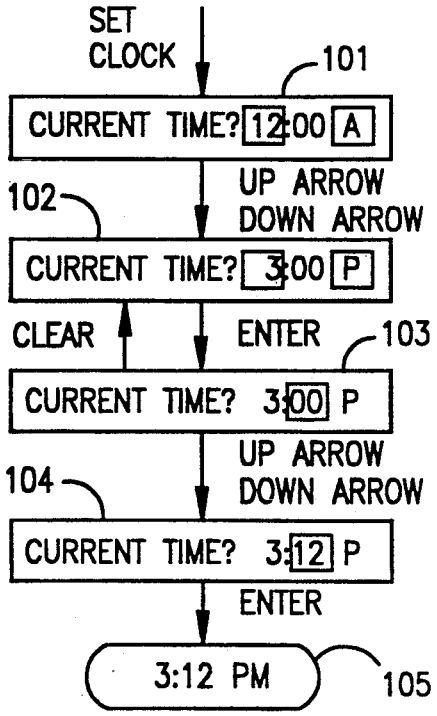
FIGS. 4–9 are block flow diagrams illustrating the operational sequence of the device shown in FIGS. 1–3.

FIG. 4 is a block flow diagram of the Set Clock function and illustrates the basic operation of the keys and display. The Set Clock function occurs whenever the device first operates or when the Set Clock key 16 is pressed. The display 10 shows a time with the hours highlighted as shown in step 101. The Up Arrow key 12 and the Down Arrow key 13 are used to change the highlighted number. When the proper hour is displayed, step 102, the user presses the Enter key 14 to accept the hours and to highlight the minutes of the time to be changed, step 103. If the Enter key 14 is mistakenly pressed, pressing the Clear key 19 returns the user to the previous step. In step 103, the Up Arrow and Down Arrow keys 12, 13 are used to change the minutes to the appropriate time. The Enter key 14 is pressed to accept the minutes and the current time is then displayed at step 105.

Figure 5:
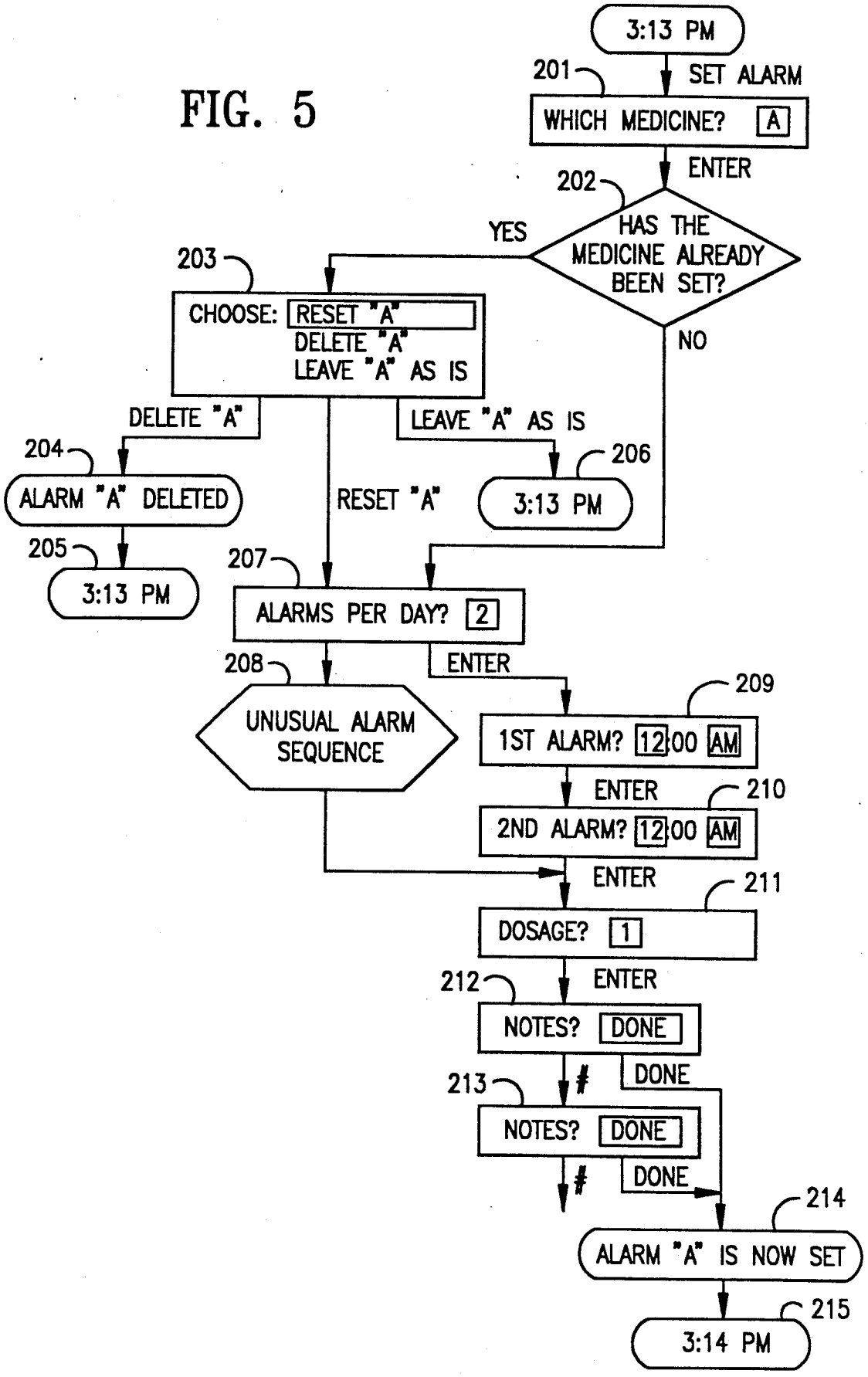

FIG. 5 is a block flow diagram of the operation of the procedure to set alarms for the various medications. The Set Alarm key 15 is pressed and the display indicates a medicine to choose at step 201. Similar to changing the time, the Up Arrow and Down Arrow keys 12, 13 are used to indicate the letter of the compartment corresponding to the medicine to be set. The Enter key 14 is used to choose the medicine when it is displayed. At step 202, the device determines whether any alarms have already been set for the chosen medicine. If alarms have been set, the user can choose whether to reset the alarms, delete the set alarms, or leave the alarms alone at step 203. The choice is made by using the arrow keys 12, 13 and the Enter key 14 in the manner described above. If the user chooses to delete the alarms for that medicine, a brief message 204 is displayed stating the alarms are deleted before returning to the current time, step 205. If the user chooses to leave the alarms unchanged, the display returns to the current time, step 206. If the user choses to reset the alarms, or no alarm has been set for that medicine, the user is then prompted to choose the number of alarms per day at step 207. The user chooses either a number or the letter "U" which is used for entering an unusual alarm sequence, more fully described with respect to FIG. 6. If the user chooses a number of alarms to set, the device then prompts the user to enter the time for each alarm, steps 209 and 210, and the number of doses to take, steps 211. The user also has to choose the number for notes or special conditions which correspond to additional information in taking the medication. The chosen numbers relate to the numbered conditions 21 on the cover section 2 of the device 1. The user can choose any number of special conditions and selects "Done" when all of the special conditions have been chosen. The display briefly lists a message 214 that the alarm is set and returns to the current time 215.

Figure 6:
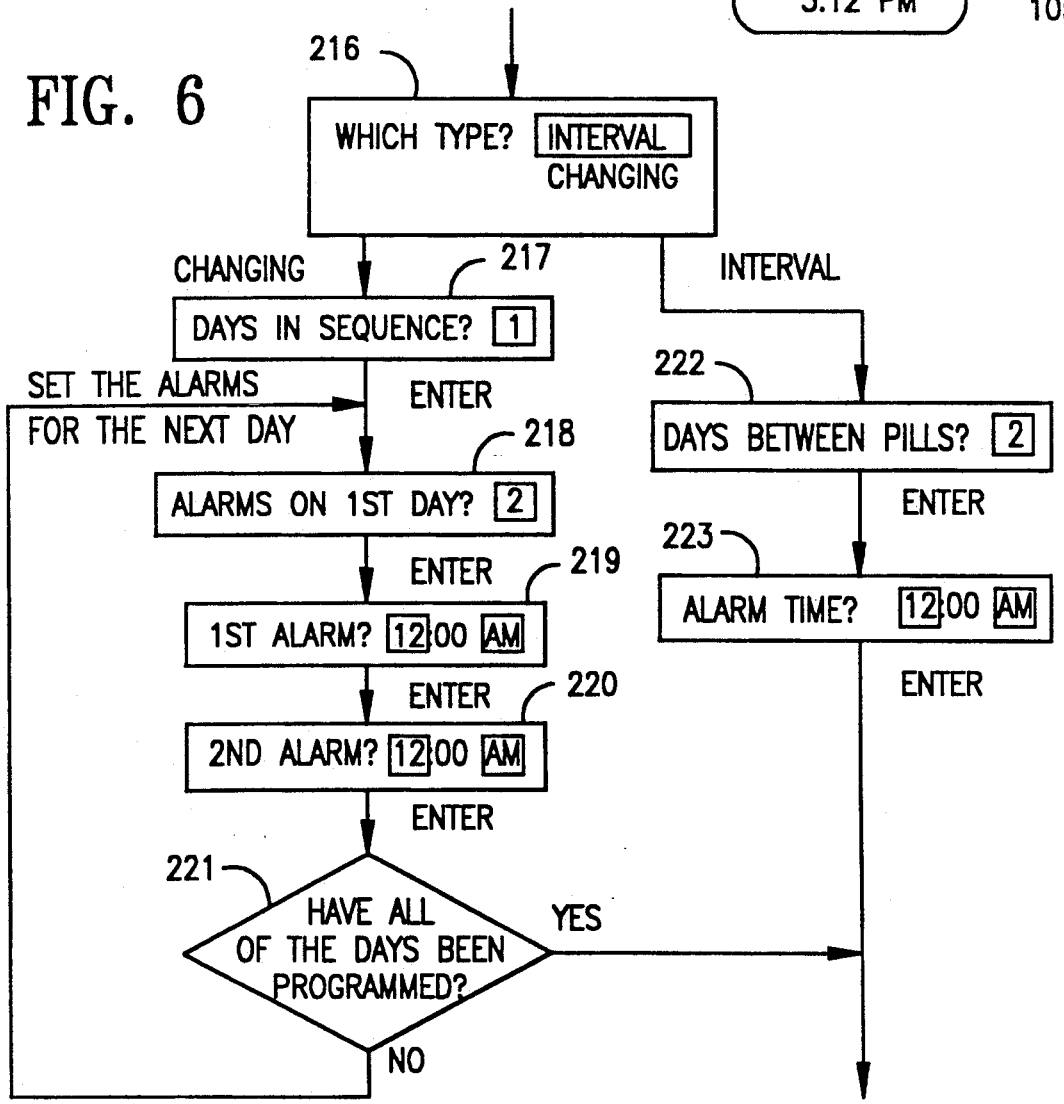

FIG. 6 shows a block flow diagram for the procedure choosing an unusual alarm sequence. At step 216, the user can choose an interval or changing sequence. For all interval sequence, the user chooses the number of days between taking the medication and sets the time for taking the medication on each day. A Changing sequence is one where the medicine is to be taken at different times on each day of the sequence. The user is prompted to select the number of days in the sequence, step 217, the number of alarms on each day, step 218, and to set the alarms for each day, steps 219, 220. Once all the days have been programmed, the user is returned to the sequence described with respect to FIG. 5 for choosing the dosage and special conditions.

Figure 7:
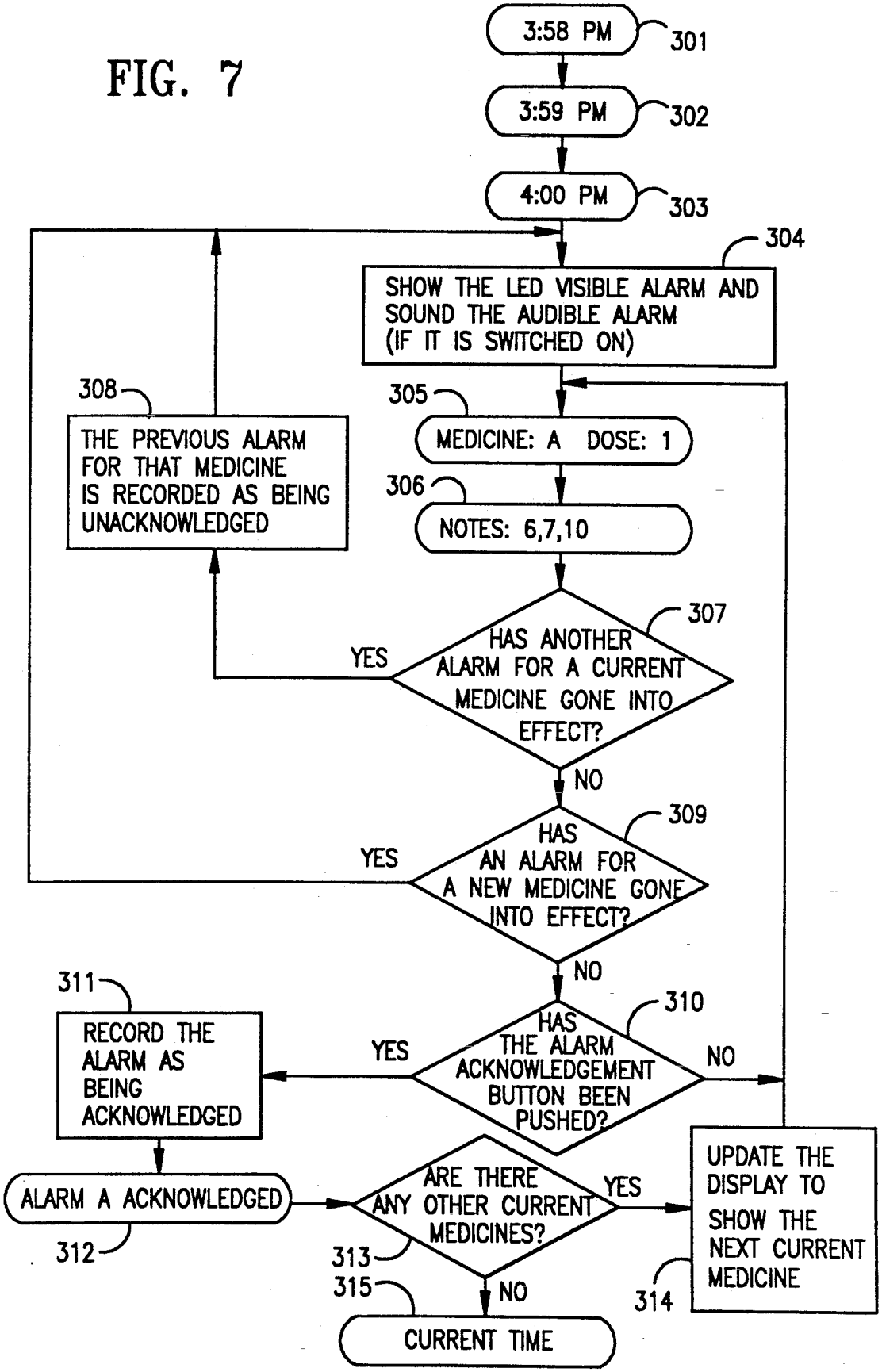

FIG. 7 illustrates a block flow diagram for operation of the device in sounding alarms and recording responses to the alarm. When the alarm time is equal to the current time, the device activates the visual indicator 11 and the audio alarm (not shown) at step 304. The audio alarm is activated for a short period of time; the visual indicator remains on until all alarms have been acknowledged. The medicine corresponding to the alarm and the dosage are briefly displayed at step 305. Then, at step 306, the special conditions corresponding to that medicine are also briefly displayed. The device cycles through steps 305 and 306 until either a button is pressed, or another alarm goes into effect. At step 307, the device determines whether the alarm which has just sounded is for a current medicine. A current medicine is one for which an alarm has sounded but has never been acknowledged. If the alarm is for a current medicine, the previous alarm for that medicine is recorded as being unacknowledged at step 308. In Step 309, the device determines whether a new alarm has gone into effect. If so, the audio alarm is activated for a short period of time, and the medicine and dosage corresponding to the new alarm are briefly displayed in step 305. Then, at step 306, special conditions corresponding to the new medicine are also briefly displayed. When the user presses the Respond to Alarm key 20, the device records the time as acknowledgment for the displayed medicine. It then determines, at step 313, whether there are any other current medicines. If so, the next current medicine is displayed at step 314. If there are not other current medicines, the current time is displayed at 315.

Figure 8:
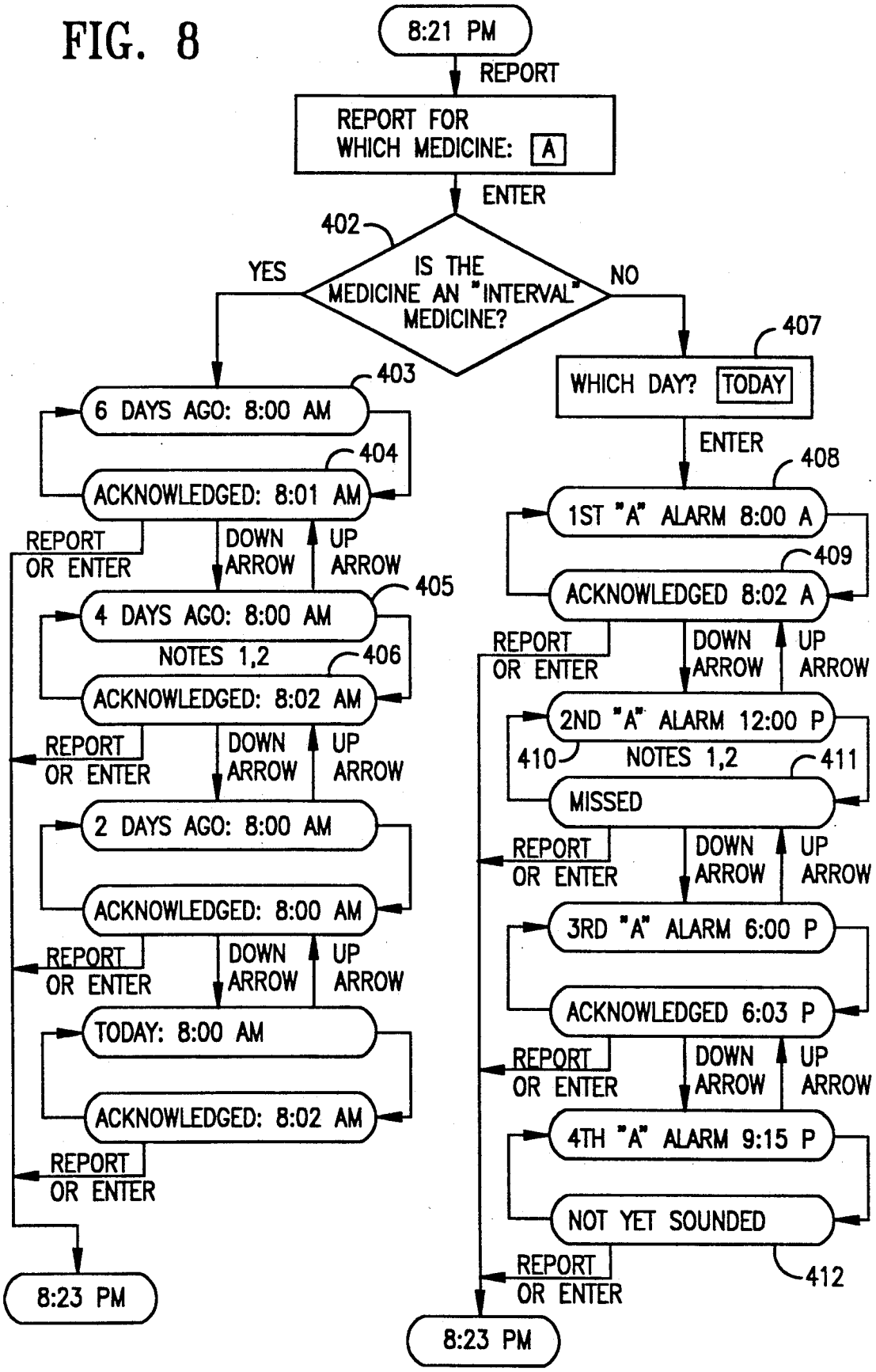

FIG. 8 illustrates a block flow diagram for a report function to view the times of alarms and the times of their acknowledgments. This function is started by pressing the Report key 17. The user then chooses the letter of the medicine for which a report is desired at step 401. If the medicine is an interval medicine, the day and time of the first alarm 403 are briefly displayed and then the time of the acknowledgment 404 is displayed. The device cycles through the day and time display 403 and the acknowledgment display 404 until another key is pressed. The Up and Down Arrow keys 12, 13 are used to display the next day and time 405 and its corresponding acknowledgment time 406. The report function is exited by pressing the Report key 17 or the Enter key 14. If the medicine is not an interval medicine, the user can then choose which day's report to review at step 407. Under the preferred embodiment of the device, the user can view the current day, or any of the past seven days. Once the day is chosen, the times and acknowledgments of the alarms are displayed in a manner similar to that for an interval medicine. The display briefly cycles the alarm time 408 and the acknowledgment time 409 until another key is pressed. If an alarm was not acknowledged, a "missed" display 411 replaces the time of the acknowledgment. Also, for the current day, any alarm which has yet to sound includes a message to that effect 412 as the acknowledgment display. Again, the Report key 17 or the Enter key 14 are used to exit the report function.

Figure 9:
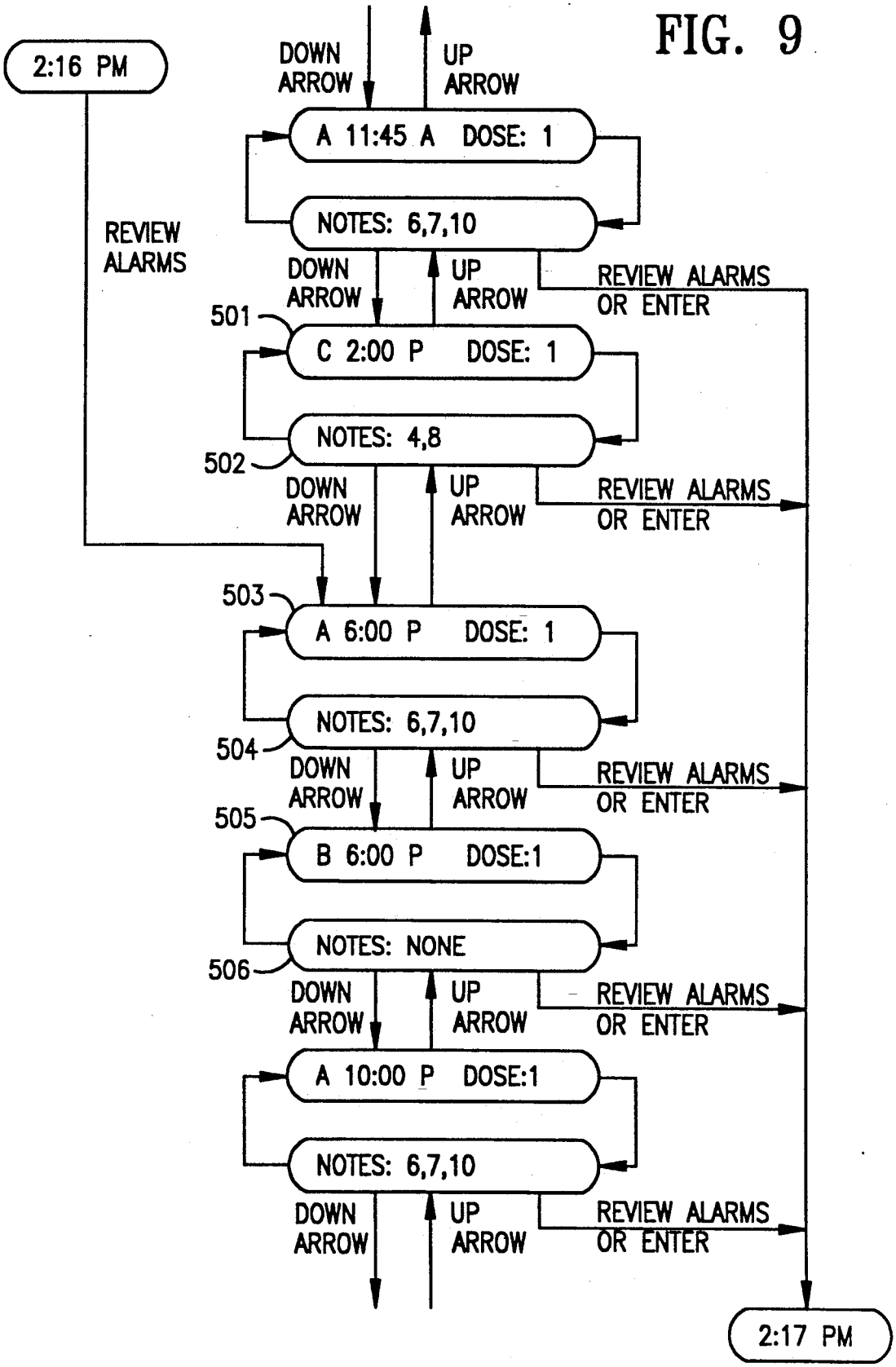

FIG. 9 shows a block flow diagram of a function which allows the user to review the alarms for all medicines that sound during the day. This function is entered by pressing the Review Alarms key 18. The time, medicine and dose information for the next alarm to sound is briefly displayed 503 and then the notes or special conditions corresponding to that medicine are briefly displayed 504 in a cyclical manner. The Up Arrow and Down Arrow keys 12, 13 are used to display the next medicine 505 and its notes 506 or the previous medicine 501 and its notes 502. By using the arrow keys, the user can view all alarms which have sounded or will sound during the day. The Review Alarms key 18 or the Enter key 14 is used to exit this function.

In the preferred embodiment, the device includes a base station (not shown) which supports the portable device on a countertop. The base station has a drawer or other area which can hold the medicine bottles used to refill the limited supply of the reminder device. Additionally, the base station could include an electrical connection to the reminder device when supporting it to provide an amplified signal for alarms.

Although a preferred embodiment is specifically illustrated and described herein, it will be appreciated that modifications and variations of the present invention are covered by the above teachings and within the purview of the appended claims without departing from the spirit and intended scope of the invention.

What is claimed is:

1. An apparatus for indicating when medicine should be taken, comprising:

clock means for providing a clock time of day;

alarm setting means for setting at least one alarm time of day for at least one medicine;

alarm means for activating an alarm when said clock time of day is the same as at least one alarm time of day;

acknowledgment means for indicating when a medicine has been taken in response to an alarm; and recording means for storing said clock time of day when said alarm was activated and said clock time of day when said acknowledgment in response to an alarm occurred.

2. The apparatus of claim 1 wherein said alarm setting means includes means for setting at least one alarm for a plurality of medicines.

3. The apparatus of claim 2 wherein said alarm means includes indicator means for indicating which of said plurality of medicines should be taken.

4. The apparatus of claim 1, further comprising:

at least one compartment means for holding a plurality of doses of medicine.

5. The apparatus of claim 1, wherein said apparatus is portable.

6. The apparatus of claim 1, further comprising:

display means for displaying the times stored in said recording means when alarms were activated and when said acknowledgments occurred.

7. The apparatus of claim 1, wherein said alarm means includes a visual alarm.

8. The apparatus of claim 1, wherein said alarm means includes an audio alarm.

9. The apparatus of claim 1, further comprising:

non-acknowledgment means for indicating when an acknowledgment has not occurred; and wherein said recording means includes means for storing said non-acknowledgment of an alarm.

10. The apparatus of claim 5, further comprising:

support means for holding said apparatus, wherein said support means also includes storage means for holding medicine bottles.

11. The apparatus of claim 10, wherein said support means includes second alarm means for activating a second alarm upon activation of said first alarm means.

* * * * *